US012751482B2

(12) United States Patent
McElhinney et al.

(10) Patent No.: US 12,751,482 B2
(45) Date of Patent: Oct. 6, 2026

(54) TONGUE WITH PRE-FOLDING SECTION

(71) Applicant: Altria Client Services LLC, Richmond, VA (US)

(72) Inventors: Patrick S. McElhinney, Chesterfield, VA (US); Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 476 days.

(21) Appl. No.: 18/484,644

(22) Filed: Oct. 11, 2023

(65) Prior Publication Data

US 2024/0032584 A1 Feb. 1, 2024

Related U.S. Application Data

(63) Continuation of application No. 15/905,230, filed on Feb. 26, 2018, now Pat. No. 11,800,889.

(51) Int. Cl.

| | |
|---|---|
| ***A24C 5/18*** | (2006.01) |
| ***A24C 1/18*** | (2006.01) |
| ***A24C 1/26*** | (2006.01) |

(52) U.S. Cl.

CPC ..... *A24C 5/1807* (2013.01); *A24C 1/18* (2013.01); *A24C 1/26* (2013.01)

(58) Field of Classification Search

None

See application file for complete search history.

(56) References Cited

U.S. PATENT DOCUMENTS

| | | | | |
|---|---|---|---|---|
| 302,521 | A * | 7/1884 | Pollard | A24C 5/1807 131/66.1 |
| 475,341 | A | 5/1892 | Pollard | |
| 739,935 | A | 9/1903 | Simon | |
| 1,838,110 | A | 12/1931 | Rundell | |
| 2,103,721 | A | 12/1937 | Herrmann | |
| 2,164,423 | A | 7/1939 | Podmore | |
| 2,208,504 | A | 7/1940 | Arelt | |
| 2,568,690 | A | 9/1951 | Warren | |

(Continued)

FOREIGN PATENT DOCUMENTS

| | | | |
|---|---|---|---|
| DE | 388703 | C | 1/1924 |
| DE | 415454 | C | 6/1925 |

(Continued)

*Primary Examiner* — Michael J Felton

(57) ABSTRACT

An example embodiment includes a tongue includes a forming surface of a forming channel, the forming channel configured to enable the shaping of shredded material into a desired form as a shredded material is drawn through the forming channel and an arrangement to introduce at least a portion of a web component adjacent a portion of the forming surface such that the introduced web component portion may be operative upon the drawn shredded material as a source of additional drawing action. The tongue may include an arrangement to draw a moving web into the tongue through a channel that converges with the working surface of the tongue, whereby the moving web is interposable between a moving column of shredded material and the first surface portion of the working surface to reduce friction. The tongue may further comprise an arrangement comprising a scalloped surface portion along the working surface of the tongue.

20 Claims, 12 Drawing Sheets

(56) References Cited

U.S. PATENT DOCUMENTS

| | | | |
|---|---|---|---|
| 2,853,079 | A | 9/1958 | Dupke |
| 3,380,352 | A | 4/1968 | Garton |
| 4,010,762 | A | 3/1977 | Strydom |
| 4,186,754 | A | 2/1980 | Labbe |
| 4,344,526 | A | 8/1982 | Quarella |
| 4,619,276 | A | 10/1986 | Albertson et al. |
| 4,732,165 | A | 3/1988 | Hakansson et al. |
| 5,012,823 | A | 5/1991 | Keritsis et al. |
| 5,810,016 | A | 9/1998 | Okumoto |
| 7,275,549 | B2 | 10/2007 | Hancock et al. |
| 2003/0136419 | A1 | 7/2003 | Muller |
| 2014/0048083 | A1 | 2/2014 | Williams et al. |
| 2016/0192698 | A1 | 7/2016 | Williams |

FOREIGN PATENT DOCUMENTS

| | | | | | |
|---|---|---|---|---|---|
| DE | 4025922 | A1 | | 2/1992 | |
| EP | 2484232 | A2 | | 8/2012 | |
| EP | 2641483 | A1 | | 9/2013 | |
| GB | 364067 | A | | 12/1931 | |
| GB | 480383 | A | | 2/1938 | |
| GB | 574861 | A | | 1/1946 | |
| GB | 2139073 | A | * | 11/1984 | ..... A24C 5/1807 |

* cited by examiner

TONGUE WITH PRE-FOLDING SECTION

CROSS-REFERENCE TO RELATED APPLICATIONS

This is a continuation of, and claims priority under 35 U.S.C. § 120 to, U.S. application Ser. No. 15/905,230, filed Feb. 26, 2018, the entire contents of which are hereby incorporated by reference.

FIELD

The present disclosure generally relates to tobacco rod formation and, in particular, to a method and apparatus for the formation of machine-made tobacco rods that may be used in, for example and without limitation, in the production of cigars, cigarettes, heated tobacco devices, vaping articles, etc.

ENVIRONMENT

Tobacco rod-forming machines may include a stationary tongue to transfer a moving column of tobacco from a tobacco feeding section to a wrapping section of the machine and to compress the continuous stream of tobacco into a size and shape conducive to folding operations along a garniture of the wrapping section.

Tobacco blends may include certain degree of moisture, such as for example, due to flavorants. Due to the moisture, tobacco borne materials may stick to and accumulate along guides, plows, garniture folders and other machine surfaces of tobacco rod forming machines and other tobacco handling apparatuses, which may then lead to jams.

SUMMARY

An aspect of the present disclosure provides a tongue comprising a forming surface of a forming channel, with the forming channel being configured to enable the shaping of a column of shredded material into a desired form as shredded material is drawn through the forming channel, and an arrangement to introduce at least a portion of a web component adjacent a portion of the forming surface such that the introduced paper component portion is operative upon the drawn shredded material as a source of additional drawing action.

In some embodiments, the tongue may be operative in a system comprising an arrangement to establish a column of shredded tobacco along a first belt, a folder and a moving flexible belt arranged to draw the web component and the shredded tobacco through the folder to form a continuous rod with the tongue operative to deliver the column of shredded tobacco from the first belt to the folder in a condition acceptable for introduction into the folder.

In some embodiments, the tongue arrangement to introduce may comprise a slot at a location along an outer side portion of the tongue, a guide channel in a converging relation with the forming channel and communicating the slot with the forming channel.

The guide channel may be configured to direct an outer edge portion of the web from outside the tongue to within the forming channel such that at least a portion of the edge portion is interposed between the column of shredded material and the forming surface, whereby contact and friction between the column of shredded material and the forming surface during the drawing is reduced.

Another aspect of the disclosure provides a method of operation of a tongue of a rod forming apparatus, comprising shaping a column of shredded material into a desired form by drawing the column of shredded material along a forming channel of a tongue and introducing at least a portion of a web into the tongue and along at least a portion of a forming surface of the forming channel such that the introduced web portion is operative upon the drawn column of shredded material as a source of additional drawing action.

Yet another aspect of the disclosure provides a tongue comprising a first piece at least partially defining a forming channel operative to shape shredded material, a second piece located along a side portion of the first piece, the second piece comprising, an upstream end portion having an arcuate surface partially defining a slot and a guide channel which converges into the forming channel of the first piece; whereby an edge portion of a web may be drawn into the forming channel through the slot and the guide channel. The guide channel may be at least partially defined between an arcuate surface of the first piece and the arcuate surface of the second piece and/or the second piece may further comprise a downstream end portion having an arcuate surface in substantial conformity with an adjacent arcuate section of the forming channel of the first piece.

A further aspect of the disclosure provides a tongue configured to transfer a moving column of shredded material from a column forming element to a column wrapping element, comprising a working surface and an arrangement operative to reduce friction along the working surface by routing a moving web into sliding contact with the least a first surface portion of the working surface of the tongue.

In some embodiments, the tongue may further comprise an arrangement to supplement friction reduction comprising a scalloped surface portion along the working surface of the tongue. In some embodiments, the scalloped surface portion may be located laterally of the first surface portion and/or the scalloped surface portion may at least partially coincide with the first surface portion and/or the scalloped surface portion may extend along at least a portion of the channel.

The disclosure also provides a related method of abating friction along a working surface of a tongue comprising providing the tongue with a capacity to route a moving web into sliding contact with at least a first surface portion of the working surface of the tongue. In some embodiments, the method may further comprise supplementing friction abatement by providing the working surface of the tongue with a scalloped second surface portion.

BRIEF DESCRIPTION OF THE DRAWING

The forms disclosed herein are illustrated by way of example, and not by way of limitation, in the figures of the accompanying drawing, in which like reference numerals refer to similar elements and in which.

DETAILED DESCRIPTION

Each of the following terms: "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Figure 1A:
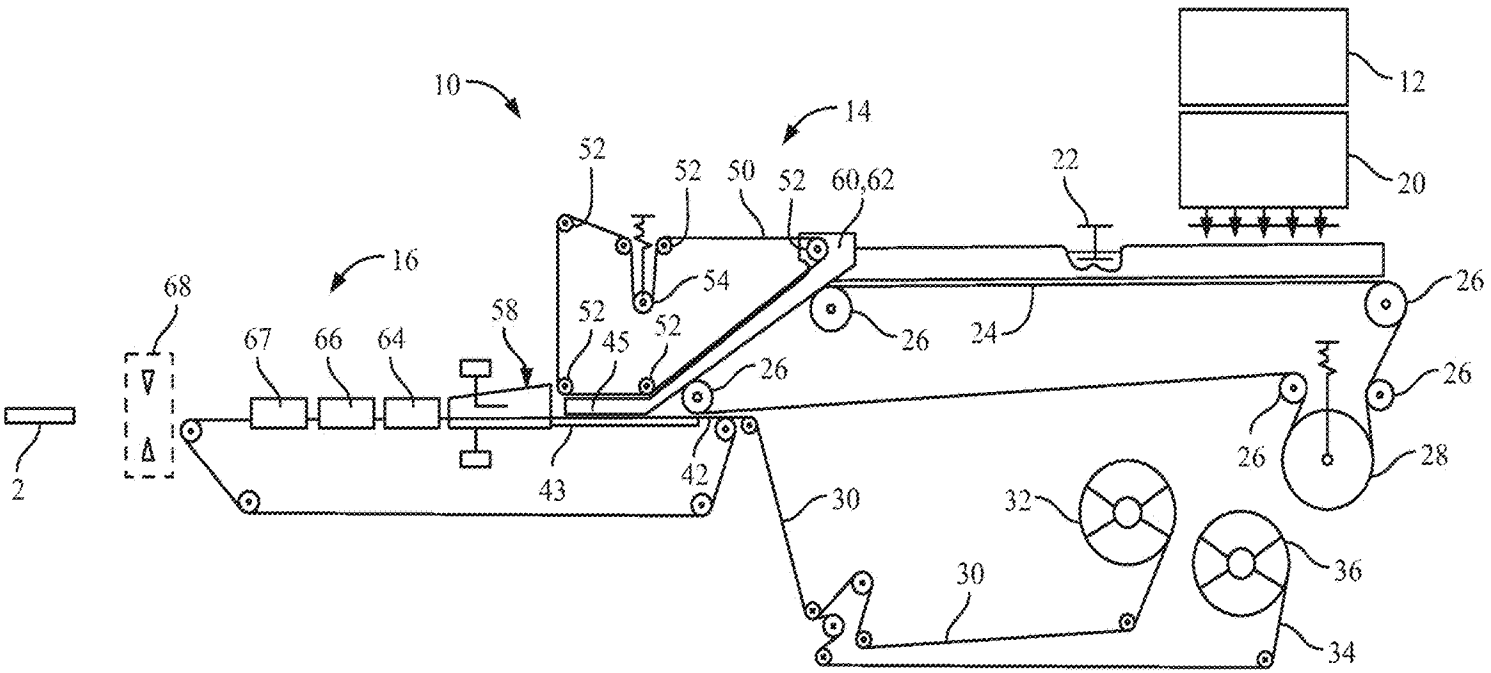
FIG. 1A is a side view representation of a tobacco rod forming apparatus which includes a tongue constructed in accordance with an embodiment of the present disclosure.
Figure 1B:
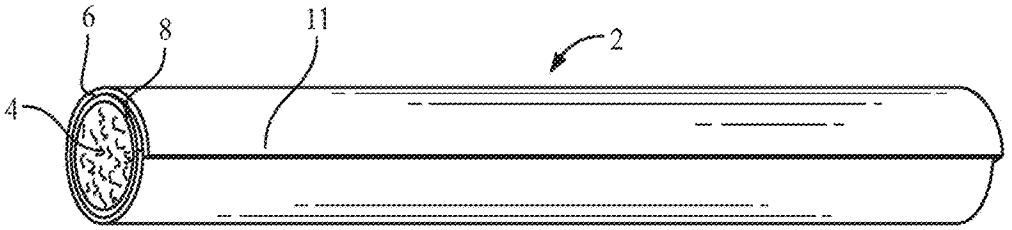
FIG. 1B is a side perspective view of a tobacco rod formed by the apparatus of FIG. 1.

Referring now to FIGS. 1A and 1B, according to an example embodiment, there is provided a rod-making apparatus 10 for the manufacture of machine-made tobacco rods, which may comprise a blend of shredded tobacco 4, and in certain embodiments an outer wrapper 6 and/or an inner wrapper binder 8. Edge portions of the outer wrapper 6 overlap and are glued together to form a seam 11.

Referring specifically to FIG. 1A, the apparatus 10 may include a tobacco feed section 12, an in-feed and tobacco column forming section 14 and a finishing (wrapping) section 16. The tobacco feed section 12 may include at least one conveyer (not shown) for receiving a stream of tobacco from a source of tobacco. The tobacco feed section 12 may also include at least one electromagnetic vibrator (not shown) for providing the stream of tobacco in a substantially uniform format.

Referring again to FIG. 1A, in one form, a vibratory waterfall feeder 20 may be positioned downstream of the tobacco feed section 12 for receiving the stream of tobacco.

The vibratory waterfall feeder 20 may feed shredded tobacco to the in-feed section 14 by establishing a column of tobacco along a lower conveyor belt 24, which may be driven and guided by a plurality of pulleys 26. The lower conveyor belt 24 may be kept in tension by a biased tension pulley 28. The stream of tobacco may optionally proceed past a trimmer unit 22, to establish a uniform height along the column of tobacco established atop the lower conveyor belt 24 by the vibratory waterfall feeder 20.

In one form, the in-feed section 14 may include an upper (compression) belt 50 positioned downstream of the vibratory waterfall feeder 20, above and in opposing relation with at least a portion of the lower conveyor belt 24 and may be likewise disposed in an opposing relation with at least a portion of a transfer or garniture tube belt 42. The upper compression belt 50 and a portion of the garniture tube belt (or transfer belt) 42 may be configured to receive and compress the stream (column) of tobacco. The upper compression belt 50 may be driven and guided by a plurality of pulleys 52 and may be kept in tension by a tension pulley 54.

A pair of squeeze bars 60 and 62 may be provided in a mutually opposing, converging relation for compressing the tobacco in a transverse direction (side to side), while the compression belt 50 and the lower conveyor belt 24 may be in a mutually opposing, converging relation for compressing the tobacco of the tobacco column from top to bottom. At the furthest (downstream) end of the lower conveyor belt 24, the tobacco column may be transferred from the lower conveyor belt 24 onto a continuous ribbon of binder web 30, which is supplied from a source of binder web 32. The binder web 30 may be mated with a wrapper web 34, which is supplied from a source of wrapper web 36, and may be supported and drawn by a transfer or garniture tube belt 42. The garniture tube belt 42 (together with the binder 30 and the wrapper 34) may be drawn along and supported by a bridge 43 in the form of an elongate plate as the garniture tube belt 42, the binder 30 and the wrapper 34 pass beneath a discharge end portion 45 of the squeeze bars 60,62 whereby the continuous, compressed column of tobacco produced by the squeeze bars 60,62 is subject to the drawing action of the garniture tube belt 42 and transferred from the squeeze bars 60,62 to the wrapping/finishing section 16 through a tongue 58, which tongue 58 is constructed in accordance with an embodiment of the present disclosure.

In some embodiments, the wrapping/finishing section 16 is configured and arranged to fold the binder and the wrapper webs 30,34, longitudinally about the continuous column of compressed tobacco and, in one embodiment, employs a first garniture (or short folder) 64 to fold the "short" side (edge) of the binder and the wrapper webs 30 and 34 against the continuous column of compressed tobacco and a second (finishing) folder 66 to fold the "long" side (edge) of the binder and the wrapper webs 30 and 34 against the continuous column of compressed tobacco, whereby a continuous rod of wrapped tobacco may be formed. In some embodiments, an adhesive is applied by an adhesive applicator adjacent the second folder 66 along a lap edge of the wrapper web 34. The resultant lap joint or seam 11 may be set by an application of heat by a heater 67 operative downstream of the second folder 66.

The continuous rod thus produced may be carried by the garniture tube belt 42 through an optional air bearing arrangement (not shown). The rod then emerges from the garniture tube belt 42 and may pass through a weight scanner (not shown) and then through a diameter gauge (not shown) before being cut into discrete rod lengths by a cutter 68 to produce units of tobacco rod 2 of a predetermined, desired length.

In certain embodiments, the binder web 30 and/or the wrapper web 34 may include tobacco.

Figure 2A:
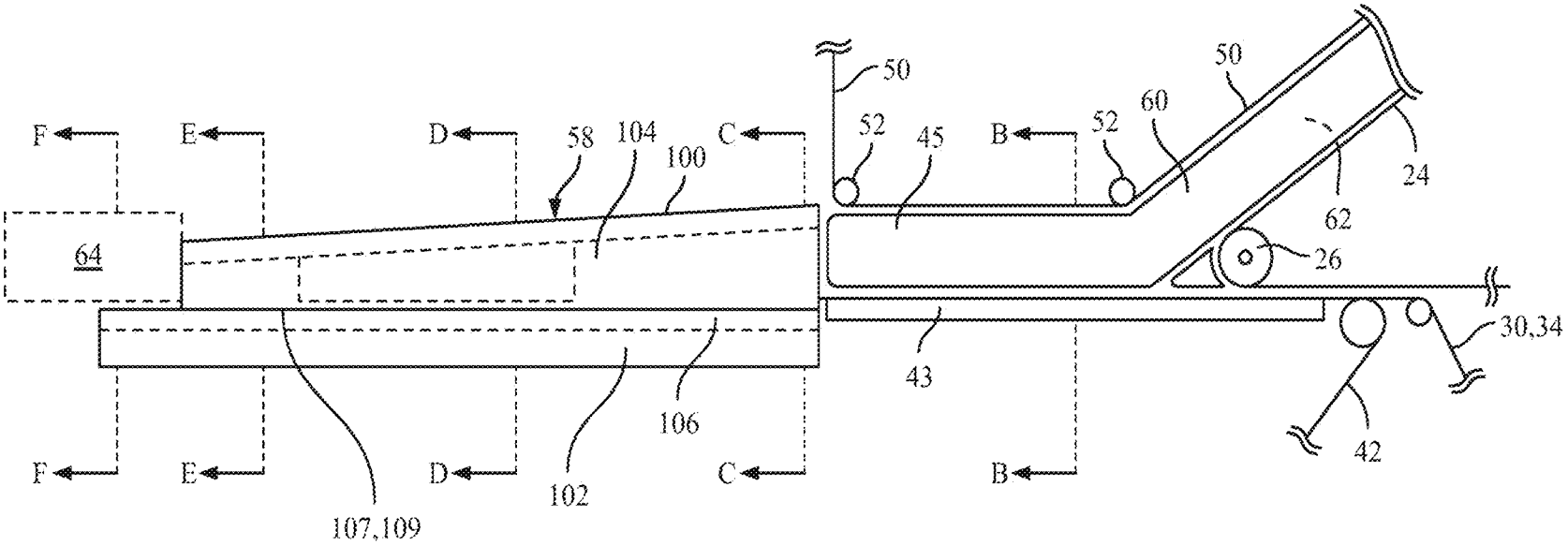
FIG. 2A is a detail view of a sub-assembly of the apparatus shown in FIG. 1A, including a tongue constructed in accordance with an embodiment of the present disclosure.
Figure 3A:
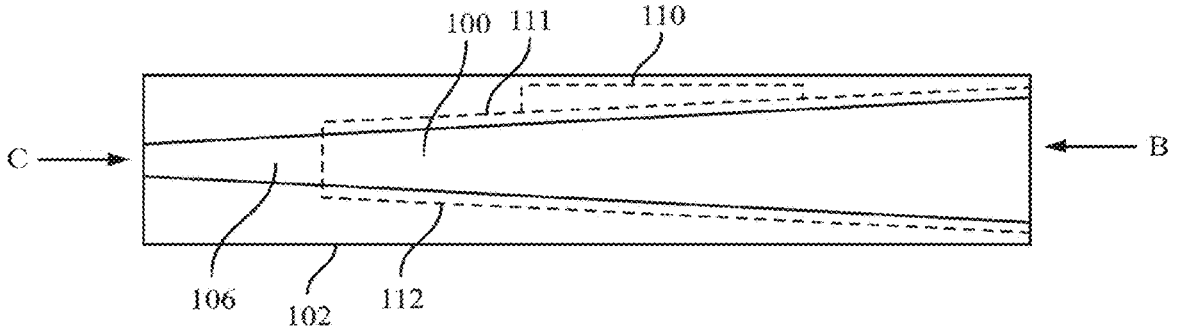
FIG. 3A is a top planar view of the base plate of the sub-assembly shown in FIG. 2A, with the superposing position of the tongue being outlined in dashed lines.
Figure 3B:
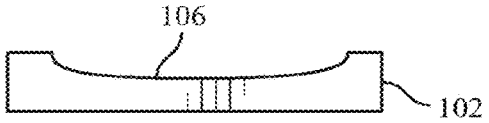
FIGS. 3B and 3C are planar end views of the base plate shown in FIG. 3A, taken in the direction of arrows B and C in FIG. 3A, respectively.
Figure 3C:
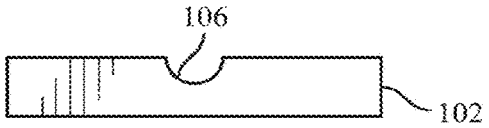

Referring now to FIGS. 2A and 3A, in some embodiments, tongue 58 may cooperate with a tongue base plate 102, which are provided with mutually corresponding, converging channels (grooves) 104, 106, respectively. Together, the converging channels (grooves) 104,106 may define a converging passage (channel) 100 through which shredded material may be transferred and compressed. The tongue 58 may be fixedly superposed over the tongue base plate 102 by a suitable support, which optionally may include a hinged connection for pivoting the tongue 58 away from the tongue base plate 102 to facilitate servicing and cleaning.

Figure 2B:
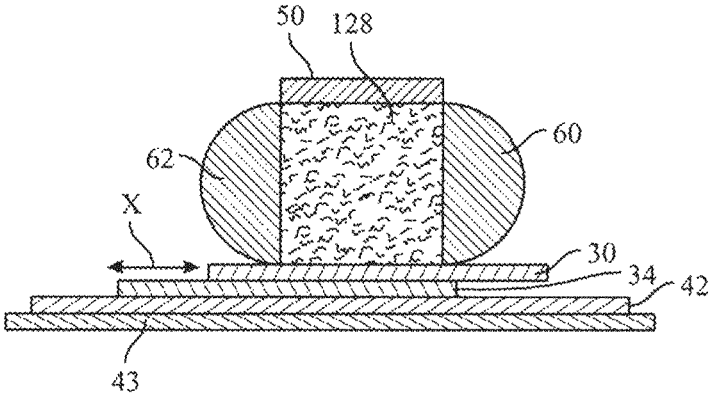
FIG. 2B is a cross-sectional view of the sub-assembly shown in FIG. 2A as viewed in the direction of double arrow B-B.
Figure 2C:
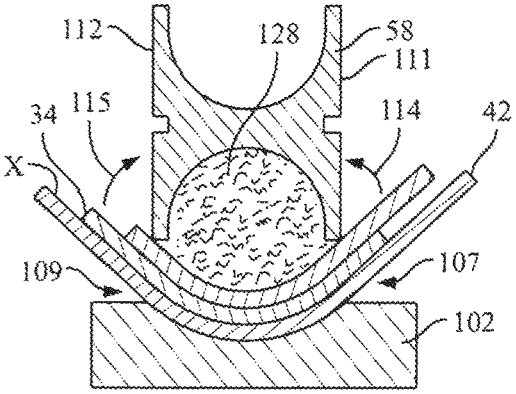
FIG. 2C is a cross-sectional view of the sub-assembly shown in FIG. 2A as viewed in the direction of double arrow C-C.

When superposed over the tongue base plate 102, the tongue 58 may be spaced apart from the tongue base plate 102 such that longitudinally extending slots 107,109 may be established along side 111 and side 112 of the tongue 58, respectively, as shown in FIG. 2C. The slots 107, 109 may be sized so as to slidingly receive outer edge portions of the tube belt 42, the wrapper web 34 and the binder web 30, which may have a tendency to curl against the sides 111,112 of the tongue 58. The curling action is represented by arrows 114,115 in FIG. 2C and are due in most part to the folding operations downstream of the tongue 58 at the short folder 64 and the long folder 66.

Figure 4:
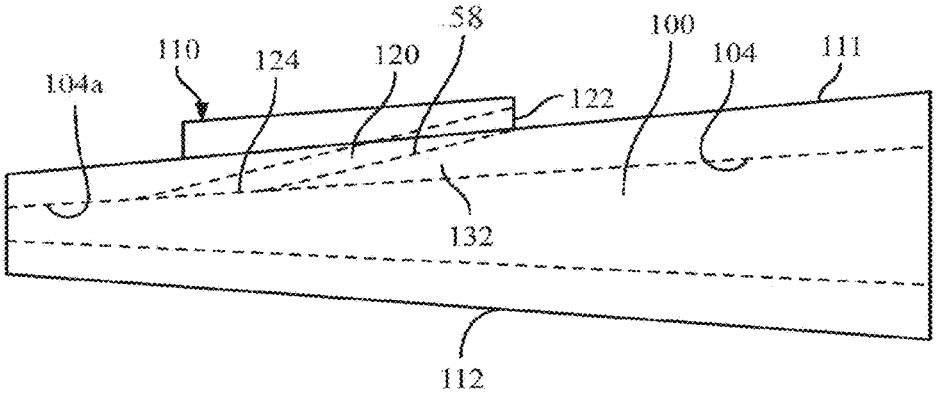
FIG. 4 is a top planar view of an example tongue constructed in accordance with an embodiment of the present disclosure.
Figure 5:
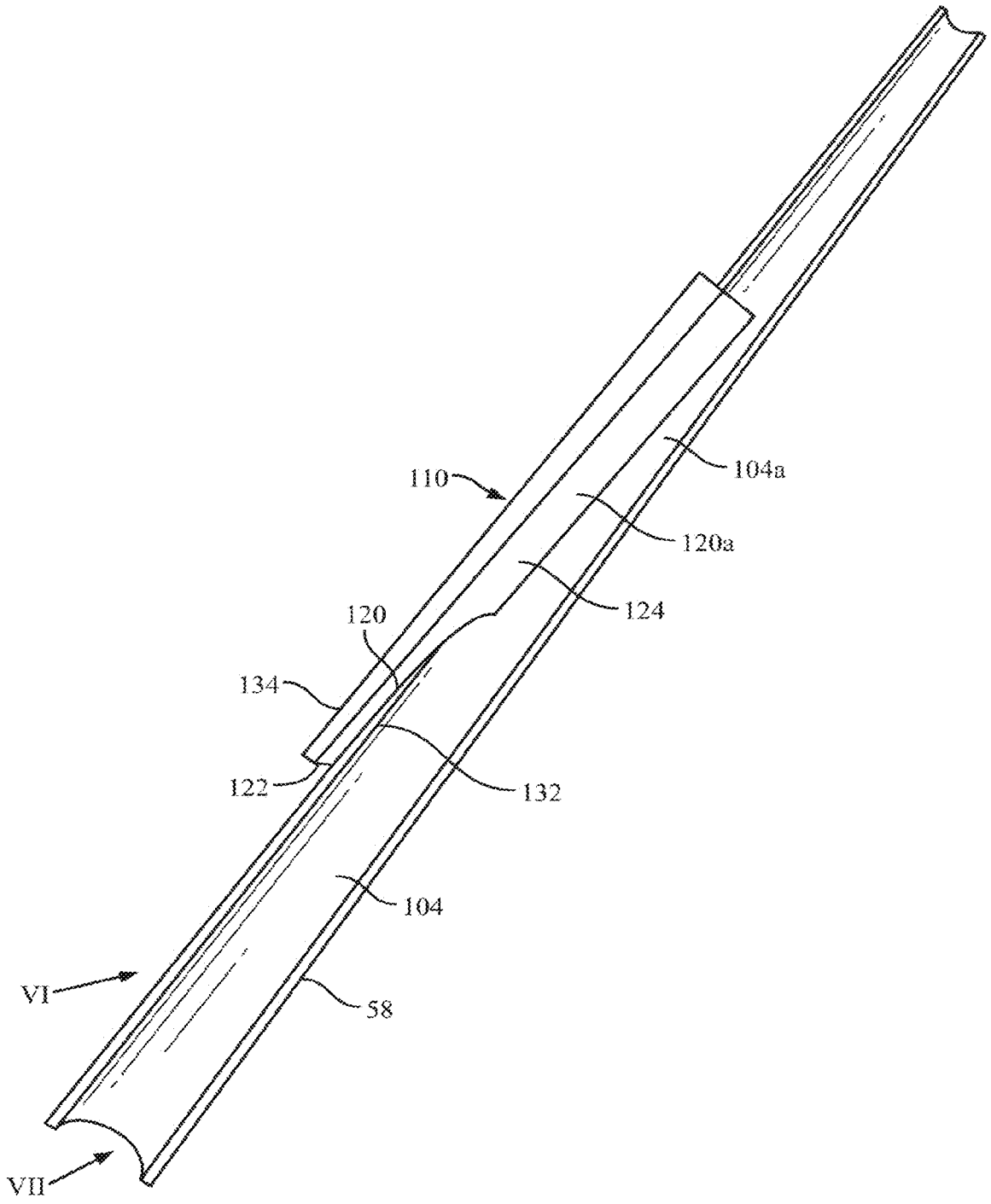
FIG. 5 is a bottom view of another example tongue constructed according to an embodiment of the present disclosure.

Referring now to FIGS. 4 and 5, in an embodiment, the tongue 58 may be provided with a pre-folding section 110, which may be located along the side 111 of the tongue 58. The pre-folding section 110 may include a lateral opening (slot) 122 at a location along the side 111 of the tongue 58 and a guide channel 120 which communicates the slot 122 with an inside portion of the converging passage 100, and more specifically, the channel 104 of the tongue 58. In some embodiments, the guide channel 120 may extend from the opening 122 to a convergence 124 with the channel 104 of the tongue 58, where a surface 120*a* (FIG. 5) of the guide channel 120 at the convergence 124 may substantially conform to the curvature of the working surface 104*a* of the channel 104. The opening 122 may be located and sized so as to admit at the binder web 30 and/or the wrapper web 34 into the guide channel 120.

Figure 2D:
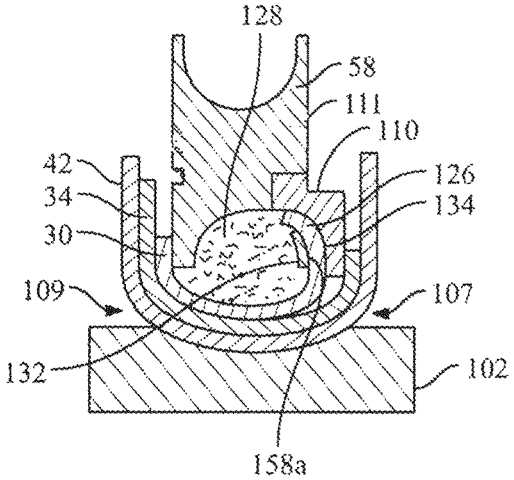
FIG. 2D is a cross-sectional view of the sub-assembly shown in FIG. 2A as viewed in the direction of double arrow D-D.
Figure 2E:
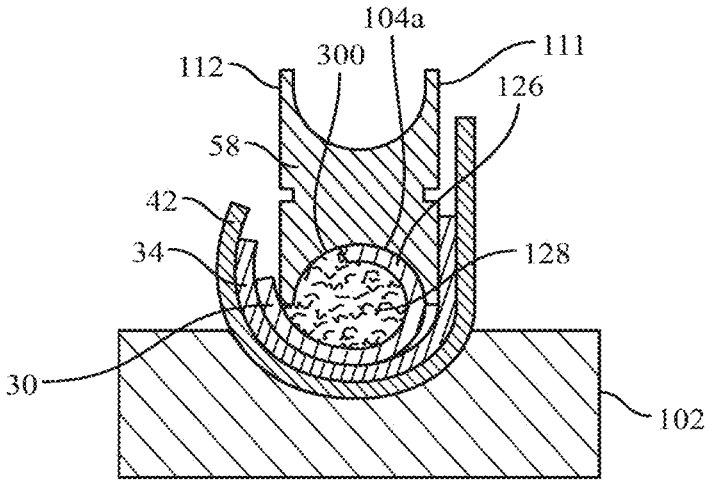
FIG. 2E is a cross-sectional view of the sub-assembly shown in FIG. 2A as viewed in the direction of double arrow E-E.

Referring now also to FIG. 2D, in some embodiments, only an outer edge portion 126 of the binder web 30 may be admitted into the guide channel 120, whereupon the guide channel 120 and adjacent finger surfaces 158*a* guide the outer edge portion 126 into a position between the column of tobacco 128 and the working (channel) surfaces 104*a* of the tongue 58 as shown in FIG. 2E. At that location and beyond (beyond the convergence 124), the inter-position of the binder web 30 between the column of tobacco 128 and the tongue 58 reduces surface to surface contact between the moving column of tobacco 128 and the remainder of the working (channel) surfaces 104*a* of the tongue 58 to thereby reduce drag acting upon the moving column of tobacco 128. Furthermore, an additional measure of drawing action is imparted to the moving column of tobacco 128 by the additional surface-to-surface contact between the moving column of tobacco 128 and the portion of the binder web 30 that is introduced within the channel 104 through the pre-folder section 110. As a result, the tendency of jams may be reduced.

Referring now to FIGS. 2A and 2B, in some embodiments, a moving column of tobacco 128 exits the exit end portion 45 of the squeeze bars 60, 62 and is disposed between the upper conveyor belt 50 and the binder web 30. At this point, the moving column of tobacco 128 is in a cross-sectional form and density that is conducive to its admission into the upstream end of the passage 100 of the tongue (which may be defined by the channels 104 and 106 of the tongue 58 and the tongue base plate 102, respectively). At this point, it is noted that the wrapper web 34 may be offset and/or provided an extra width relative to the binder web 30 such that the wrapper web 34 extends laterally further by a certain distance "x" so as to facilitate application of the adhesive to form the seam 11 such as by way of a glue gun 130 shown in FIG. 2F.

Referring now to FIG. 2C, in certain embodiments the outside edge portions of the garniture tube belt 42, the binder web 30 and the cigar wrapper web 34 extend laterally beyond slots 107, 109 defined between the tongue 58 and the tongue base plate 102. Due to the folding actions of the short folder 64 and long the folder 66, the outside edge portions of the garniture tube belt 42, the binder web 30 and the wrapper web 34 begin to curd as indicated with arrows 114,115 toward the side walls of the tongue 58 into a generally u-shaped form. It is noted that the lateral extension the wrapper 34 may be greater on side 112 of the tongue 58 than on side 111 of the tongue 58.

Figure 7:
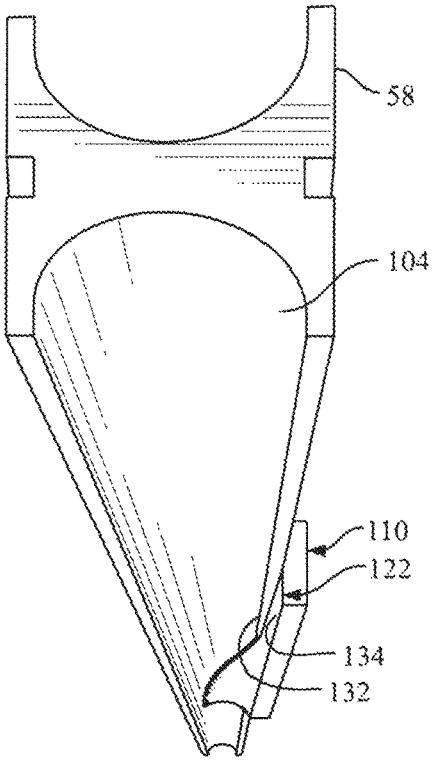
FIG. 7 is a perspective view of the tongue shown in FIG. 5 in the direction of arrow VII.

Referring now to FIGS. 2D, 5 and 7, in some embodiments, as the column of tobacco 128, the binder web 30 and the wrapper web 34 move further along the tongue 58 by the drawing action of the garniture tube belt 42, the outer edge portion of the binder web 30 is routed through the opening 122 of the guide channel 120 whereupon it is interposed, at least initially, between surfaces 158*a* of a longitudinally extending finger 132 and opposing surfaces of a longitudinally extending wall 134 of the pre-folding section 110. These opposing surfaces may be rounded and/or conical so as to minimize disturbance of binder web 30 as it passes through the guide channel 120. The routing of the binder web 30 through the opening 122 may be established by manually threading the binder web 30 through the opening 122 and guide channel 120 before machine start-up, or mechanically through a machine arrangement.

Still referring to FIG. 2D, once the column of tobacco 128, the binder web 30 and the cigar wrapper web 34 are drawn further along the tongue 58 beyond the terminus of the finger 132, the edge portion 126 of the binder web 30 is folded against the column of tobacco 128, which may provide alleviation of drag and promote greater pulling action as previously described.

Figure 2F:
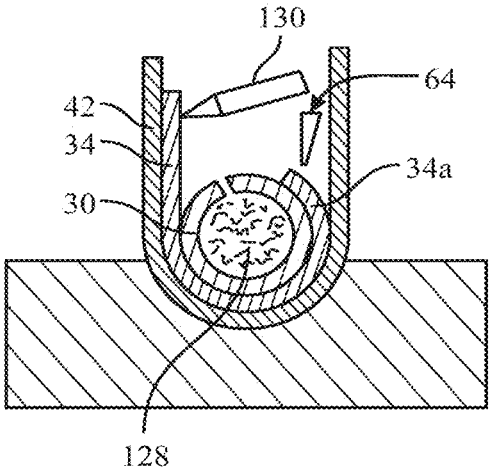
FIG. 2F is a cross-sectional view of the sub-assembly shown in FIG. 2A as viewed in the direction of double arrow F-F.
Figure 2G:
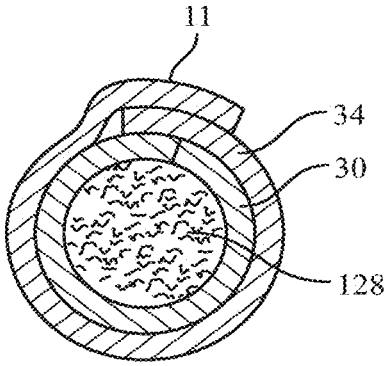
FIG. 2G is a cross-sectional view of the continuous rod formed after passage through the long folder and the sub-assembly shown in FIG. 2A.

Referring now to FIG. 2F, in certain embodiments, upon exiting the tongue 58, the incomplete, continuous, tobacco rod form is drawn through the short folder station 64, whereupon the short side 34*a* of the wrapper web 34 is folded against the tobacco column 128. Thereafter, the tubular tobacco rod form is drawn past the glue applicator 130 and then through the long folder 66 which folds the long side 34*b* of the wrapper web against the tobacco column 128 to complete the tobacco rod 2, including the seam 11, as shown in FIG. 2G. In certain embodiments, there may only be a binder web 30 and no wrapper web, and in certain embodiments there may only be a wrapper web 34 and no binder web.

Figure 6:
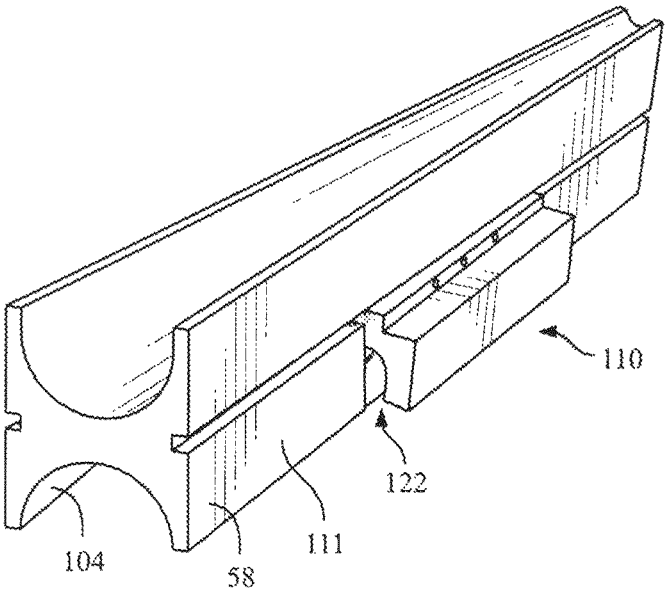
FIG. 6 is a perspective view of the tongue shown in FIG. 5 in the direction of arrow VI.
Figure 8A:
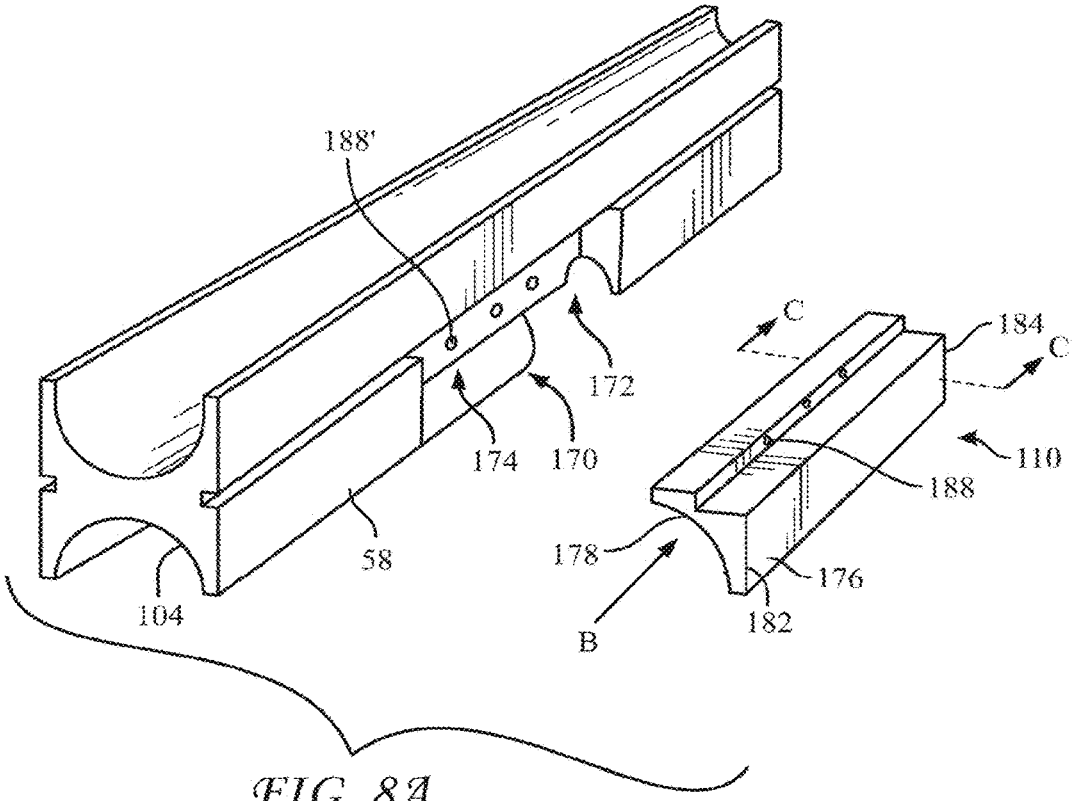
FIG. 8A is an exploded view of a two piece construction of a tongue in accordance with an embodiment of the disclosure, comprising a main body and a lateral insert piece.

Referring now to FIGS. 6 and 8A, in an embodiment, the tongue 58, together with its pre-folding section 110, may be constructed as separate pieces which are joinable to form a complete tongue 58 with a pre-folder section 110. For example, the main body of the tongue 58 may be formed by molding, machining or other suitable technique to form the general structure that encloses the channel 104. A cut out 170 may then be machined along a portion of the side 111 of the tongue body of sufficient depth to breach (open-up) a downstream portion 172 of the channel 104. The cut-out operation may include rounding an upstream portion 174 of the cut-out 170 into a configuration that facilitates guidance and sliding movement of the binder web 30 along surfaces of the upstream portion 174. In some embodiments the rounded surfaces of the upstream portion 174 may be conical and may correspond with the finger 132 shown in FIGS. 2D, 4, 5 and 7.

Figure 8B:
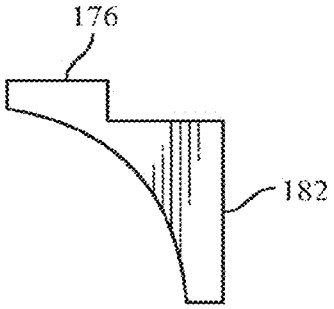
FIG. 8B is a planar view of an upstream end portion of the lateral insert piece of FIG. 8A, as viewed in the direction of arrow B.
Figure 8C:
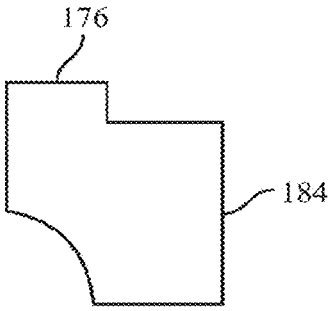
FIG. 8C is a planar view of a downstream end portion of the lateral insert piece of FIG. 8A, as viewed in the direction of double arrow C.
Figure 8D:
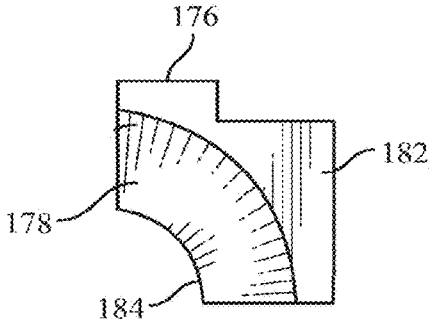
FIG. 8D is a planar and view of the lateral insert piece of FIG. 8A, as viewed in the direction of arrow B.

Referring now also to FIGS. 8B and 8C, construction of an example embodiment may further include fabrication of an elongate pre-folder piece 176, which may include a conical surface 178 which converges from an upstream end portion 182 of the pre-folder piece 176, where the radius of curvature of the conical surface 178 may be greater than the radius of the channel 104 at that corresponding location, and converges to the downstream end portion 184 of the pre-folder piece 176, where the radius of curvature of the conical surface 178 may equal to or proximate of the radius of the channel 104 at that corresponding location. The described two piece construction may facilitate formation to different surfaces of the channel 104 of the main body and the conical surface 178 of the pre-folder piece 176. It is contemplated that the surface 178 of the section piece 176 may be other than conical, while the surface 178 may still slidingly guide an edge portion 126 of a binder web 30 into the confines of the channel 104.

In some embodiments, the pre-folder piece 176 may be joinable to the body of tongue 58 with pins or screws or other suitable connectors that may extend through a plurality of pinholes 188,188' that may be provided in the pre-folder piece 176 and the main body of the tongue 58.

It is contemplated that the pre-folding tongue 58 may be constructed using techniques other than the two piece technique described above. For example, computer assisted or other manufacturing techniques may be employed to form the entire structure as a single, integrated piece.

It is also contemplated that in certain embodiments openings and/or channels may be formed in the tongue base plate 102 to facilitate admission of the binder web 30 into the downstream section of the passage 100 and/or channel 104 of the tongue 58. It is also contemplated that in certain embodiments both the binder web 30 and the wrapper web 34 may be directed into the channel 104 of the tongue 58 via a pre-folder section 110. It is also possible in certain embodiments to form the slot 122 such that it opens transversely, such as with a transversely directed slot-shaped or arcuate bore.

It is noted that structure of the tongue 58 as depicted in the figures (such as FIG. 6) includes an curved-shaped upper structure that is similar to channel 104 (but flipped), which may be provided in certain embodiments, but is not necessary in the practice of the teachings provided herein. In other words, the upper portion of tongue 58 could have any shape that may be desired.

It is further noted that in certain embodiments, the convergence 24 may be located upstream of where jamming would be more likely to occur if the tongue were lacking a pre-folder section 110. In some embodiments, for example, the convergence 24 may be located approximately one-third length or one-quarter length of the tongue upstream of the exit of the tongue. Locating the convergence 24 closer to the exit (verses farther to the exit) of the tongue may minimize compression of the binder web (and/or wrapper), which in turn may minimize risk of wrinkling as the binder web (and/or wrapper) passes through the interior of the tongue 58

(e.g., as it passes through a portion of the channel 104). In other embodiments, however, the convergence 24 may be placed at locations further downstream in the tongue or further upstream in the tongue. For example, it may be located early in the tongue to start wrapping the tobacco earlier in the process.

In certain embodiments, slot 122 may be located along the upstream half of the tongue so as to provide a gradual transition of the web from being disposed outside the tongue to within the tongue, but in other embodiments slot 122 may be located past the upstream half of the tongue.

Figure 9:
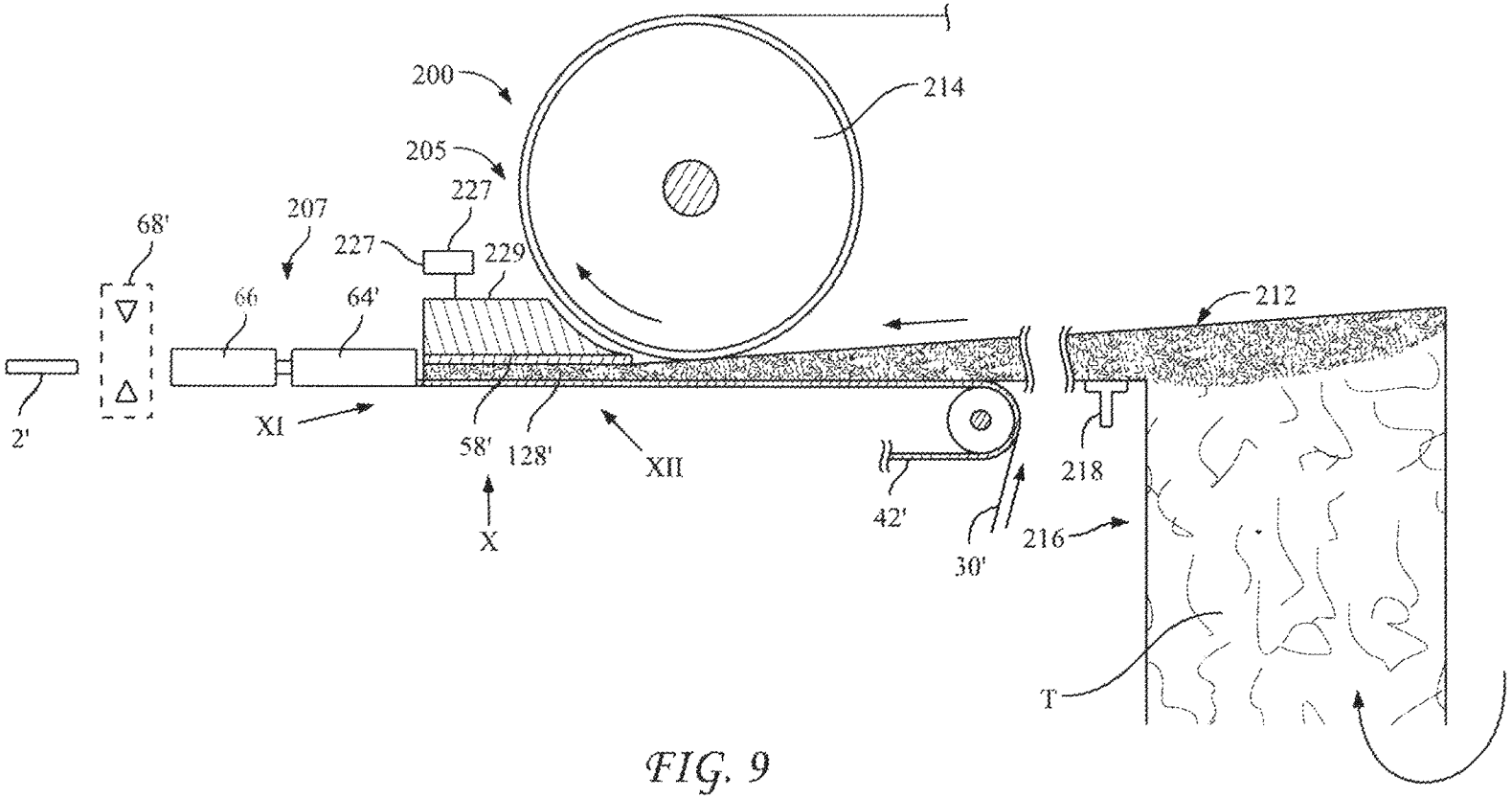
FIG. 9 is a side cross-sectional representation of an assembly of components of a tobacco rod forming machine which cooperate with a tongue constructed in accordance with another embodiment of the present disclosure.

Referring now to FIG. 9, certain embodiments provide a tobacco rod making apparatus 200 comprising a forming (feeding) section 205 configured to establish a moving column of shredded tobacco and a wrapping section 207 configured to enwrap a ribbon of wrapper 30' about the moving column of shredded tobacco so as to form a continuous tobacco rod, which is severed into rods 2' at a knife 68'. The tobacco rods 2' may be equivalent in length to a single tobacco rod for use for use in a smoking or heating device, or may be equivalent to twice the length (2-up) or multiples of a 2-up configuration (such as 4-up, 6-up or longer).

In some embodiments, the forming section 205 may comprise an endless vacuum tape 212 driven by a roller 214, a tobacco chimney section 216 where shredded tobacco T is entrained and directed into contact with an underside of the vacuum tape 212, whereupon tobacco accumulates along the tape 212. An eucreteur (trimmer knife) assembly 218 adjacent the tobacco chimney section 216 may be supported for movement toward and away from the vacuum tape 212 so as to adjust amount of tobacco delivered by the vacuum tape 212. The movement of the eucreteur 218 may be responsive to a control signal indicative of weight and/or density. Beyond the eucreteur 218 and the operative extent of the vacuum tape 212, the column of tobacco established underneath the vacuum tape 212 is transferred onto a moving, continuous ribbon of wrapper 30', which, together with the tobacco, is being drawn by an endless garniture tube belt 42' toward the wrapping section 207 of the rod making apparatus 200.

The wrapping section 207 of the rod making apparatus 210 may comprise first, short folder 64', a second, long folder 64' and a knife to 68', which are configured to operate in like manner to previously described folders 64, 66 and the knife 68 of the other embodiment, to form the desired tobacco rod 2'. The desired tobacco rod 2' may include a core of cut filler tobacco that is enwrapped with a wrapper 30'.

Still referring to FIG. 9, the rod making apparatus 200 further comprises a tongue 58' which is configured to compress and transfer the column of shredded tobacco 128' from the forming section 205 into the short folder 64' of the wrapping section 207 and which includes a pre-folding section 110', according to an embodiment.

Figure 11:
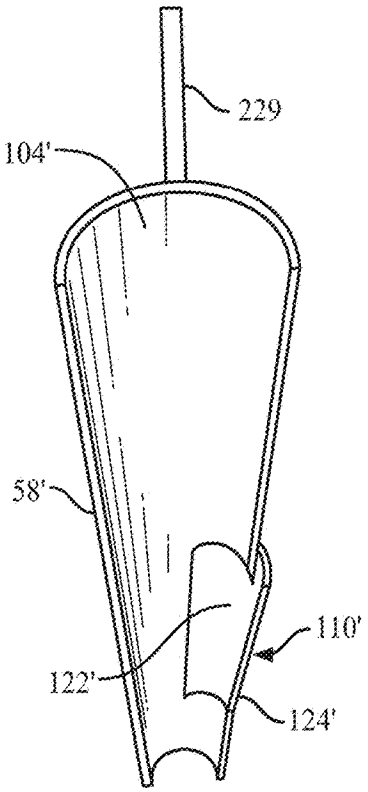
FIG. 11 is a perspective view of the tongue shown in FIG. 9 as viewed in the direction of arrow XI.
Figure 10:
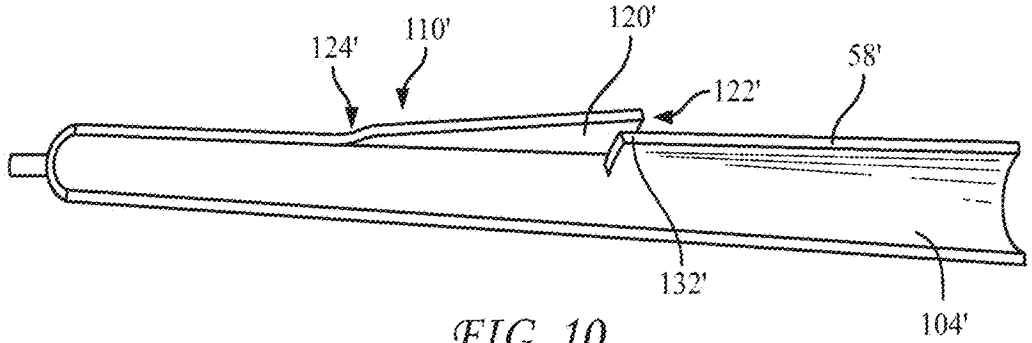
FIG. 10 is a perspective view of the tongue shown in FIG. 9 as viewed in the direction of arrow X.
Figure 12:
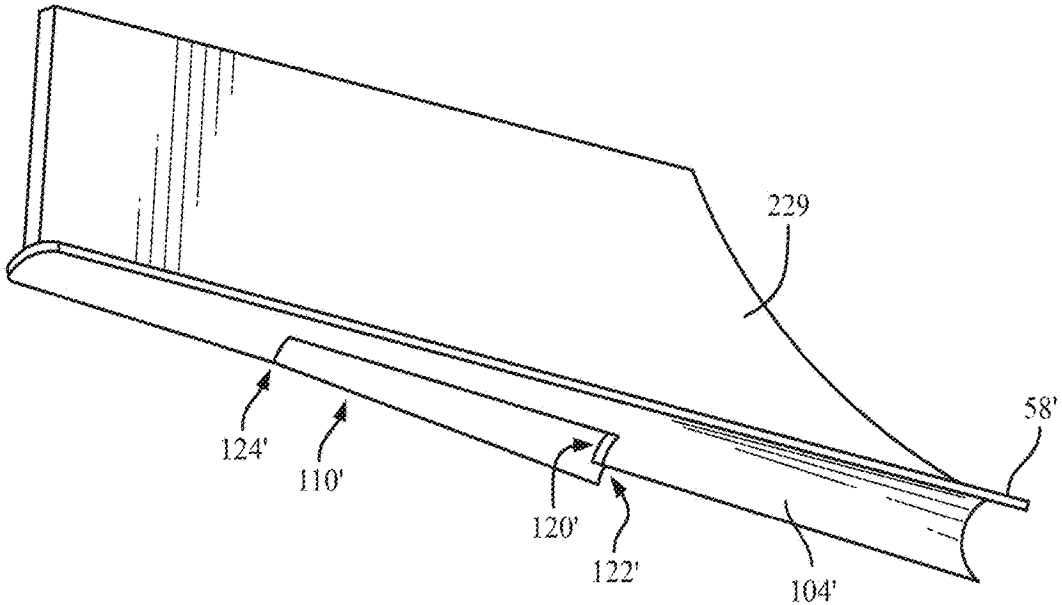
FIG. 12 is a perspective view of the tongue shown in FIG. 9 as viewed in the direction of arrow XII.

Referring now to FIGS. 10, 11 and 12, in some embodiments, the tongue 58' may comprise an interior working surface **104*a*' which defines a central, converging channel 104', and a pre-folding section 110' which may include an opening (slot) 122' at a location along the short side 111' of the tongue 58' and a guide channel 120' which communicates the slot 122' with an inside portion of the channel 104'. In some embodiments, the channel 120' extends from the opening 122' to a convergence 124' with the channel 104' of the tongue 58', where the surfaces of the channel 120' at the convergence 124' may substantially conform with curvature of the surfaces of the channel 104'. The opening 122' may be located and sized so as to admit an outer edge portion 126' of a tobacco wrapper 30' into the guide channel 120', whereupon the guide channel 120' and adjacent surfaces of a finger portion 132' of the tongue 58' guide the outer edge portion 126' into a position between the column of tobacco 128' and the working (channel) surfaces 104' of the tongue 58'. At that location and beyond (beyond the convergence 124'), the inter-position of the wrapper 30' between the column of tobacco 128' and the working (channel) surfaces 104' of the tongue 58' reduces surface to surface contact between the moving column of tobacco 128' and the working (channel) surfaces 104' of the tongue 58' and may thereby reduce drag acting upon the moving column of tobacco 128'. Furthermore, an additional measure of drawing action is imparted to the moving column of tobacco 128' by the additional surface to surface contact between the moving column of tobacco 128' and the portion of the wrapper 30' that is introduced within the channel 104' through the pre-folder section 110'. As a result, jams near the exit section of the tongue 58'** may be reduced.

The pre-folding tongue 58' may be constructed as a unitary piece, using, for example, computer assisted or other manufacturing techniques. In addition, the pre-folding tongue 58' of the present embodiment may be constructed of a stainless steel. Pre-folding tongue 58' may be pre-formed with the desired form, including pre-folder section 110', or may be cut and bent to form pre-folder section 110'. In some embodiments, the finger 132' may be extended beyond that shown in FIG. 10 so as to minimize the possibility of tobacco escaping from beneath the tongue 58' as a result of conditions inducing a back flow of tobacco up the channel 120' and out the opening 122'.

In some embodiments, the pre-folding tongue 58' may be supported by a suitable mechanical connection 227 between the frame of the rod-making machine 200 and a mounting blade (rib) 229 of the pre-folding tongue 58'. The mechanical connection 227 may be adjustable so as to achieve a desired degree of compression and/or proximity to the pulley 214.

Referring back to FIG. 2E, in some embodiments, an edge portion 126 of a web is interposed between the tobacco column 128 and working surfaces 104 of the pre-folding tongue 58 (58') to reduce friction and drag, yet some portions of the working surfaces **104*a* of the tongue 58, such as the region 300 in FIG. 2E, may remain in contact with the moving tobacco column 128. At or about the region 300 (to one side of where the guide channel 120 routes the web into the channel 104**), levels of friction and drag may remain unabated.

Referring now to FIG. 13-16, further embodiments of the present disclosure may comprise a tongue 58" constructed in accordance with any of the previously described embodiments, but further including scalloped surface portions (such as, for example, at one or more of 105, **105*b*, 105*c*, 105*d* and/or 105*e*, etc.). Scalloped surface portions may be placed at various discrete locations in the interior surface of the tongue 58", throughout the entire interior surface of the tongue 58", along the guide channel 120", and/or surfaces along the finger 132". With the addition of the scalloped surfaces, surface to surface contact between the tobacco column 128** and the working surfaces may be further reduced.

Figure 13:
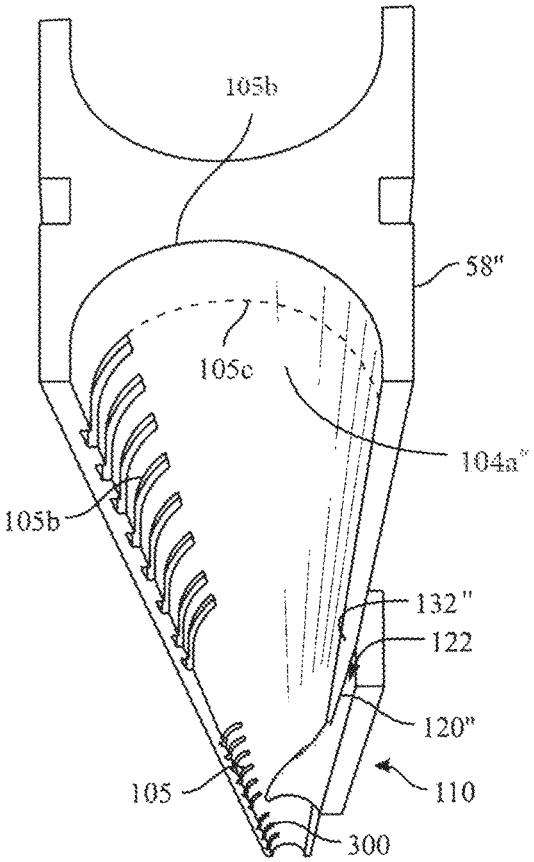
FIG. 13 is a perspective view of the tongue shown FIG. 7 in accordance with still another embodiment of the present disclosure, which include scalloped regions along certain working surfaces of the tongue.
Figure 14:
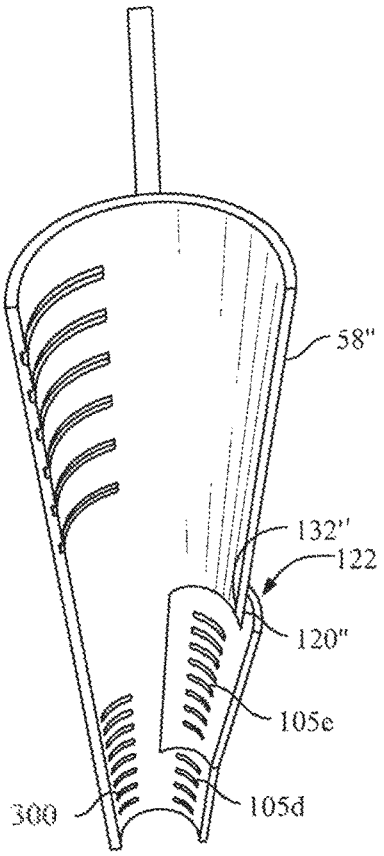
FIG. 14 is a perspective view of the tongue shown FIG. 11 in accordance with yet another embodiment of the present disclosure, which includes scalloped regions along certain working surfaces of the tongue.

In certain embodiments, the scalloped surface portions may be extended entirely across the working surface **104*a*", as represented by the dashed line 105*c* in FIG. 13**.

Figure 15:
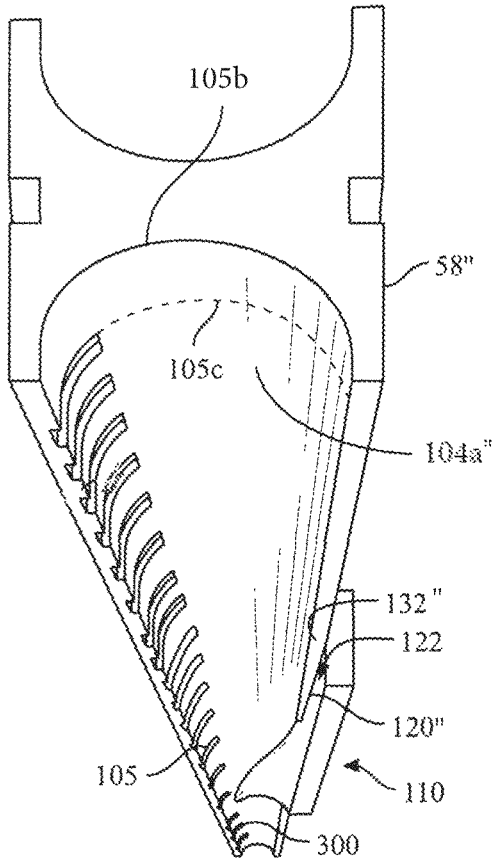
FIG. 15 is a perspective view of the tongue shown FIG. 13 in accordance with another embodiment of the present disclosure, which include scalloped regions along certain working surfaces of the tongue.
Figure 16:
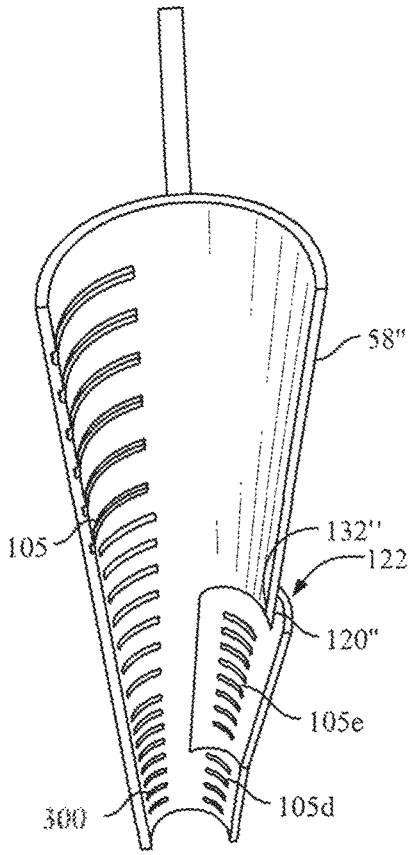
FIG. 16 is a perspective view of the tongue shown FIG. 14 in accordance with yet another embodiment of the present disclosure, which include scalloped regions along certain working surfaces of the tongue.

Referring now to FIGS. 15 and 16, in some embodiments, the scalloped surface portions 105 may extend continuously along all or substantially all of the interior surface of the tongue 58".

It is to be realized that any of the scalloped surfaces 105*a-e* and others may be employed to supplement friction/drag abatement, either alone or in combination in any of the previously described embodiments and may take the form of various geometries, such as crosshatching, parallel lines of indentation, stipples, knurling, which may be directed either longitudinally or transversely (laterally) across working surfaces 104*a* of the particular tongue 58. In addition, a certain style or spacing of scallops may be employed in one region of the interior surface, whereas other regions may be provided with a different style or spacing.

It is also to be realized that the teachings herein have applications in the formation of rods of any type of material (such as for example, and without limitation, shredded material or other flowable or fibrous materials, such as shredded tobacco but also included reconstituted tobacco). The teachings herein are also applicable to the formation of such rods that are suitable or incorporation into cigars, cigarettes, heat-not-burn devices, vaping devices, etc., or to certain forms of filter rod manufacturing. The reference to a paper, wrapper or web herein is reference to any type of wrapper or web suitable for wrapping materials such as those discussed herein.

PCT

Illustrative, non-exclusive examples of some embodiments of apparatus and methods are presented in the following enumerated paragraphs. It is within the scope of the present disclosure that an individual step of a method recited herein, including in the following enumerated paragraphs, may additionally or alternatively be referred to as a "step for" performing the recited action.

PCT 1. A tongue configured to transfer a moving column of shredded material from a column forming element to a column wrapping element, comprising: a working surface; and an arrangement operative to reduce friction along the working surface by routing a moving web into sliding contact with the least a first surface portion of the working surface of the tongue.

PCT 2. A tongue comprising: a working surface of a forming channel, the forming channel configured to enable the shaping of shredded material into a desired form as shredded material is drawn through the forming channel; and an arrangement to route at least a portion of a web adjacent a first portion of the working surface such that the routed web portion is operative upon the drawn shredded material as a source of additional drawing action.

PCT 3. The tongue of PCT 1 or 2 operative in a system for manufacturing tobacco rods, comprising: an arrangement to establish a column of shredded tobacco along a first belt; a folder; and a moving flexible belt arranged to draw the web and the shredded tobacco through the folder to form a continuous rod; the tongue operative to deliver the column of shredded tobacco from the first belt to the folder in a condition acceptable for introduction into the folder.

PCT 4. The tongue of any of PCT 1-3, wherein the arrangement to route comprises: a slot at a location along an outer side portion of the tongue; and a guide channel in a converging relation with the forming channel and communicating the slot with the forming channel.

PCT 5. The tongue of any of PCT 1-4, wherein the shredded material comprises a shredded cigar tobacco and the web component comprises a cigar binder and/or a cigar wrapper.

PCT 6. The tongue of any of PCT 1-4, wherein the shredded material comprises a cigarette cut filler tobacco and the web component comprises a cigarette wrapper.

PCT 7. The tongue of PCT 1 or 2, wherein the arrangement to route includes an arrangement to draw a moving web into the tongue through a channel that converges with the working surface of the tongue, whereby the moving web is interposable between a moving column of shredded material and the first surface portion of the working surface.

PCT 8. The tongue of PCT 1, 2 or 7, further comprising a scalloped surface portion along the working surface of the tongue.

PCT 9. The tongue of PCT 8, wherein the scalloped surface portion is located laterally of the first surface portion.

PCT 10. The tongue of any of PCT 9, wherein the scalloped surface portion at least partially coincides with the first surface portion.

PCT 11. The tongue of any of PCT 7, wherein the scalloped surface portion extends along at least a portion of the channel.

PCT 12. The tongue of any of PCT 7-11, wherein the second surface portion conforms with a pattern, the pattern including at least one of a knurled pattern a roughened pattern, a pitted pattern, a crosshatched pattern, a speckled pattern, a transversely ribbed pattern, and/or an axially ribbed pattern.

PCT 13. A method of abating friction along a working surface of a tongue, comprising providing the tongue with a capacity to route a moving web into sliding contact with at least a first surface portion of the working surface of the tongue.

PCT 14. The method of PCT 13, wherein the routing of web includes drawing the moving web into the tongue through a channel that converges with the working surface of the tongue, whereby the moving web is interposed between the shredded material and the first surface portion of the working surface.

PCT 15. The method of PCT 14 further comprising supplementing friction abatement by providing the working surface of the tongue with a scalloped surface portion.

PCT 16. The method of PCT 15, wherein the provision of a scalloped surface portion includes locating the scalloped surface portion laterally of the first surface portion.

PCT 17. The method of PCT 14, wherein the provision of a scalloped surface portion includes at least partially coinciding the scalloped surface portion with the first surface portion.

PCT 18. The method of PCT 17, further comprising routing the moving web into the tongue through a channel that converges with the working surface of the tongue, wherein the provision of a scalloped surface portion includes extending the scalloped surface portion along at least a portion of the channel.

PCT 19. The method of any of PCT 13-18, wherein the shredded material comprises a cigar tobacco, the web comprises a cigar binder.

PCT 20. The method of any of PCT 13-18, wherein the shredded material comprises a cigarette cut filler tobacco and the web comprises a cigarette wrapper.

While the present disclosure has been illustrated by reference to particular embodiments, those of ordinary skill in the art will appreciate that the disclosure lends itself to variations not necessarily illustrated herein. For this reason, then, reference should be made solely to the appended claims for purposes of determining the true scope of the present invention.

We claim:

1. A tongue for use in shaping shredded materials, the tongue comprising:

a forming surface including a first curvature having a first radius, the forming surface configured to shape the shredded materials into a desired form as the shredded materials move therethrough; and a pre-forming surface including a second curvature having a second radius that is greater than the first radius and configured to introduce at least a portion of a web adjacent to a portion of the forming surface.

2. The tongue of claim 1, wherein the pre-forming surface is located along a side portion of the forming surface.

3. The tongue of claim 2, wherein a first separate piece includes the forming surface and a second separate piece includes the pre-forming surfaces, the first separate piece and the second separate piece being joinable to form the tongue.

4. The tongue of claim 3, wherein the first separate piece includes a first plurality of pinholes, the second separate piece includes a second plurality of pinholes, and the first separate piece and the second separate piece are joinable using connectors that extend through the first and second plurality of pinholes.

5. The tongue of claim 3, wherein the first separate piece defines a cavity shaped to receive the second separate piece.

6. The tongue of claim 5, wherein the forming surface has a first end and an opposing second end, the first end of the forming surface has a third radius, and the second end of the forming surface has a fourth radius that is smaller than the third radius, the first radius being between the third radius and the fourth radius.

7. The tongue of claim 6, wherein the pre-forming surface has a first end and an opposing second end, the first end of the pre-forming surface has the second radius, and the second end of the pre-forming surface also has the second radius.

8. The tongue of claim 1, wherein the tongue further comprises:

a guide channel connecting the forming surface and the pre-forming surface.

9. The tongue of claim 8, wherein the pre-forming surface includes a slot, and the guide channel connects the slot and the forming surface.

10. The tongue of claim 1, wherein at least a portion of the forming surface is a scalloped portion.

11. The tongue of claim 10, wherein the scalloped portion of the forming surface includes a knurled pattern, a roughened pattern, a pitted pattern, a crosshatched pattern, a speckled pattern, a transversely ribbed pattern, an axially ribbed pattern, or any combination thereof.

12. The tongue of claim 10, wherein the scalloped portion of the forming surface extends continuously along substantially all of the forming surface.

13. The tongue of claim 10, wherein the portion of the forming surface is located away from a non-forming surface.

14. The tongue of claim 1, wherein at least a portion of the pre-forming surface is a scalloped portion.

15. The tongue of claim 14, wherein the scalloped portion of the pre-forming surface includes a knurled pattern, a roughened pattern, a pitted pattern, a crosshatched pattern, a speckled pattern, a transversely ribbed pattern, an axially ribbed pattern, or any combination thereof.

16. The tongue of claim 14, wherein the scalloped portion of the pre-forming surface extends continuously along substantially all of the pre-forming surface.

17. The tongue of claim 1, wherein at least a portion of the forming surface is a scalloped portion and at least a portion of the pre-forming surface is a scalloped portion.

18. The tongue of claim 1, wherein the web includes paper, a binder web, a wrapper web, a cigarette wrapper web, cigar binder, a cigar wrapper, or any combination thereof.

19. The tongue of claim 1, wherein the shredded material includes shredded cigar tobacco, cigarette cut filler tobacco, or a combination of shredded cigar tobacco and cigarette cut filler tobacco.

20. The tongue of claim 1, wherein the tongue is configured to cooperate with a tongue base plate having a surface corresponding with the forming surface.

* * * * *